United States Patent [19]

Kennard et al.

[11] 4,261,514

[45] Apr. 14, 1981

[54] BO BOY LAWN SPRINKLER

[76] Inventors: Lee V. Kennard; George Spector, both of c/o George Spector 3615 Woolworth Bldg., 233 Broadway, New York, N.Y. 10007

[21] Appl. No.: 48,751

[22] Filed: Jun. 15, 1979

[51] Int. Cl.[3] ..... B05B 1/00

[52] U.S. Cl. ..... 239/211; 239/227; 239/242; 239/261

[58] Field of Search ..... 239/211, 227, 236, 242, 239/261

[56] References Cited

U.S. PATENT DOCUMENTS

| | | | |
|---|---|---|---|
| 2,030,605 | 2/1936 | Moore | 239/211 |
| 2,087,175 | 7/1937 | Voight | 239/211 |
| 2,635,007 | 4/1953 | Norman | 239/227 |

*Primary Examiner*—Richard A. Schacher

[57] ABSTRACT

An ornamental lawn sprinkler which includes a figure holding a nozzle of the garden hose, the figure being activated by the moving water so to pivot reciprocally to opposite right and left about a horizontal axis, and at a same time rotate directionally about a vertical axis.

3 Claims, 3 Drawing Figures

2
23
32
41
25
27
21
26
22
25a
24
10
20
42
28
29
12
14
31
34
33
19
17
11
15
16
13
18
30
39
40
38
36
35
37
43

BO BOY LAWN SPRINKLER

This invention relates generally to lawn sprinklers.

It is well known that all lawn sprinklers presently marketed are made with utility purpose only in mind, so that they are not at all interesting to look at.

It is a principal object of the present invention to provide a lawn sprinkler which in addition to serving a utility purpose, is also attractive in appearance.

Another object is to provide a lawn sprinkler which is humerous in appearance and in action, so that it will appeal to observers and accordingly is certain to outsell commercially presently marketed lawn sprinklers.

Figures 1, 2, 3:
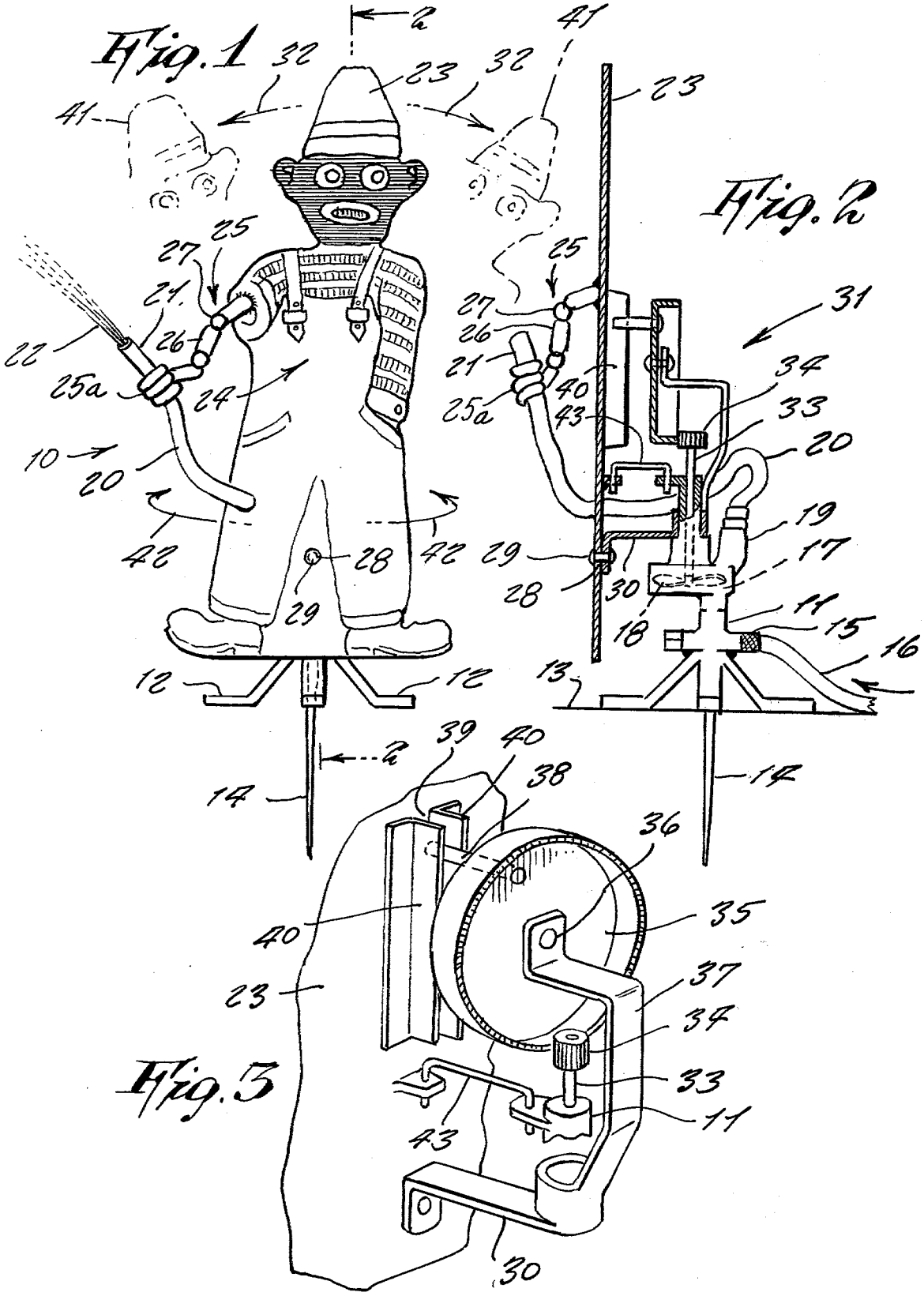
FIG. 1 is a front view of the invention, and indicating by arrows that the figure tilts to each side and also pivots to each side reciprocally as it sprinkles water on a lawn, so to be comical and at a same time distributing the water over a wide area.
FIG. 2 is a side view thereof, showing the mechanism at a rear powered by the water.
FIG. 3 is a rear perspective view showing the mechanical operating structure.

Referring now to the drawing in greater detail, the reference numeral 10 represents a Bo Boy Lawn Sprinkler according to the present invention, and which includes a base 11 having three legs 12 for resting upon a ground surface 13 and a single central prong 14 for being downwardly inserted into the ground in order to be stationary. A coupling 15 on the base is provided for connection to a garden hose 16 supplying water to the sprinkler. The base is made with a turbine chamber 17 in which a turbine blade 18 intercepts the flow of water through the base, so that the blade is thus rotated thereby. A water outlet 19 on the base is connected to a short, flexible hose 20 fitted with nozzle 21 on its end for spraying a lawn or garden with a water spray 22.

In the present invention, a flat display panel 23 made preferably of sheet metal is cut on its peripheral edge into a shape of an humerous FIG. 24 such as a person or other being, and the front side of the panel may be lithographed or otherwise painted. Thus, as shown in FIG. 1, the figure can represent a comical person 24, the drawn figure including all the components of a persons body, except one arm 25 which is comprised of a plurality of sections 26 adjustably attached together in a line by means of ball and socket universal joints 27 therebetween. One end of the arm is welded to a front side of the panel 23 at a position where the FIG. 24 arm should be. The opposite end of the arm is fitted with a sleeve 25*a* into which the nozzle is fitted, the sleeve being in the shape of a hand with fingers closed so to give the impression of holding the hose nozzle.

The panel 23 has a hole 28 near its lower end receiving a rivet 29 secured on a bracket 30 stationarily mounted on the base, the panel being pivotable on the rivet. A mechanism 31 mounted on top of the base and upon a rear side of the panel provides means for the panel to pivot about the rivet 29 reciprocally side to side as shown by arrows 32.

The mechanism includes the blade 18 being affixed on a shaft 33 extending outwardly of the base turbine chamber and having a knurlled friction gear 34 affixed to its outer, upper end, and which engages frictionally a knurlled peripheral edge of a gear 35 rotatable about a rivet 36 supported on a bracket 37 mounted on the base. A pin 38 is mounted eccentrically on the gear 35, and is slidable inside a channel 39 formed between two angle-shaped rails 40 affixed on a rear side of panel 23.

Thus, in operative use, as the water from the water supply hose 16 moves through the turbine chamber on its way to the nozzle, it rotates the blade and gear 34 so to cause the gear 36 to also rotate so that the pin 38 held between the rails 40, causes the panel to reciprocally pivot side to side, and the FIG. 23 thus to appear to be rocking on his feet as indicated at 41.

Additionally the FIG. 23 is made to turn directionally sideward while thus rocking, as indicated by arrows 42, by means of a link 43 pivotally attached at one end to a rear side of the panel, and pivotally attached at its other end to the base, and which pulls the panel in an arcuate travel around the axis of shaft 33 as the panel is sidewardly pivoted.

These combined motions make the FIG. 23 comical, and at the same time make the water spray 22 to spray a broad area of lawn.

We claim:

1. A lawn sprinkler, comprising in combination, a base for stationary placement on a ground, a water intake on said base attachable to a garden water supply hose, a water outlet on said base connected to a short flexible hose fitted with a nozzle on its end, a display figure supported on said base holding said nozzle, said figure being pivotable about a horizontal axis, including means for reciprocally rocking said figure about said horizontal axis including further means for rotating said figure about a vertical axis both said means being responsive to water flow.

2. The combination as set forth in claim 1 wherein said figure comprises a flat panel peripherally cut and lithographed on its front side in the appearance of a humorous character.

3. The combination as set forth in claim 2 wherein said means comprise a turbine in said base driven by water flow therethrough, said turbine driving a gearing including an eccentric pin in an output gear, said pin traveling in a channel of said panel, said panel being pivotable about a horizontal pivot, and a link pulling said pivoting panel around a vertical axis of said turbine.

* * * * *